US006692420B2

(12) United States Patent
Walden

(10) Patent No.: US 6,692,420 B2
(45) Date of Patent: Feb. 17, 2004

(54) HIP MOUNTED EXERCISING DEVICE WITH PRECISION TETHER ADJUSTER

(76) Inventor: Drue Walden, P.O. Box 1117, Waynesboro, GA (US) 30830

( * ) Notice: Subject to any disclaimer, the term of this patent is extended or adjusted under 35 U.S.C. 154(b) by 0 days.

(21) Appl. No.: 09/993,949

(22) Filed: Nov. 16, 2001

(65) Prior Publication Data

US 2003/0096686 A1 May 22, 2003

(51) Int. Cl.[7] ..... A63B 71/00

(52) U.S. Cl. ..... 482/148; 273/DIG. 19; 272/119; 272/143; 272/128; 272/1 R

(58) Field of Search ..... 482/148; 273/DIG. 19; 272/119, 143, 1 R, 128

(56) References Cited

U.S. PATENT DOCUMENTS

| | | | | | |
|---|---|---|---|---|---|
| 3,224,774 | A | * | 12/1965 | Klotz | 273/97 R |
| 3,342,482 | A | * | 9/1967 | Paolone | 273/97 R |
| 3,479,027 | A | | 11/1969 | Fryer | |
| 3,863,924 | A | * | 2/1975 | Gagnon | 273/97 R |
| 4,121,822 | A | | 10/1978 | DiSabatino et al. | |
| 4,596,387 | A | | 6/1986 | Roberts | |
| 4,765,748 | A | * | 8/1988 | Fidalgo | 273/1 G |
| 4,911,432 | A | * | 3/1990 | Walden | 272/119 |
| 4,971,334 | A | | 11/1990 | Stewart | |
| 5,199,715 | A | | 4/1993 | May | |
| 5,244,206 | A | | 9/1993 | Clark et al. | |
| 5,358,258 | A | | 10/1994 | Killion | |
| 5,586,760 | A | | 12/1996 | Hauter | |

* cited by examiner

*Primary Examiner*—Nicholas D. Lucchesi
*Assistant Examiner*—L Amerson

(57) ABSTRACT

A precision tether adjuster for use with a rebound board, an exercising device including the tether adjuster, and a method for achieving high levels of aerobic exercise in an enjoyable fashion using the device. The device includes a rebound board, and a precision tether adjuster having first strip of hook-and-loop fastening material attached to the rebound board, and a tether having a first end attached to a ball and a second end attached to a second, mating strip of hook-and-loop fastening material. The excess length of the tether is wrapped around the second strip, which is mated horizontally across the first strip at the appropriate vertical level for the user. The length and vertical position of the tether are now optimized to suit the user's requirements, and the tether is secured firmly between the mating strips of hook-and-loop fabric.

36 Claims, 3 Drawing Sheets

HIP MOUNTED EXERCISING DEVICE WITH PRECISION TETHER ADJUSTER

BACKGROUND OF THE INVENTION

1. Field of the Invention

The present invention relates to an exercising device carrying an elastic ball on a stretchable tether. In particular, the present invention relates to an exercising device such as a hip-mounted rebound board with a precision tether adjuster, wherein the length of the tether and its vertical position with respect to the face of the rebound board are easily and accurately adjustable to suit each individual user, thereby providing the required coordination between the board and the tether respective to each individual user.

2. Discussion of Background

Medical professionals increasingly emphasize the importance of healthy lifestyles, including the dual roles of diet and exercise, in maintaining well-being throughout one's life. By way of example, a diet rich in fruits and vegetables may reduce the incidence of certain types of malignancies. Aerobic exercise helps maintain lung capacity and reduces the rate of heart disease, weight training helps build muscle mass, and weight-bearing exercise slows the rate of bone loss associated with osteoporosis.

Many people find it difficult to establish and maintain a regular, long-term exercise program. Their reasons vary, but typically include some combination of the following: lack of time, lack of suitable equipment, no place to store equipment, no suitable facilities within a reasonable distance from home or office, no interest in organized sports or group exercise classes, or sheer boredom with a chosen exercise regimen. Thus, much exercise equipment is purchased on impulse and languishes, unused, in the owner's garage or basement.

Clearly, the availability of simple, compact, cost-effective exercise equipment that provides beneficial results while being easy and fun to use would help many people maintain their commitment to exercising over the long term. A variety of game and exercise devices has been developed to address this need, some of them aimed at training for team sports. Several devices include closures of VELCRO or other hook-and-loop material; others use VELCRO to attach game pieces to a game board. For example, Hauter's waist-mounted soccer training apparatus has an adjustable belt, a tether, and a mesh net for holding a soccer ball (U.S. Pat. No. 5,586,760). The length of the belt is adjustable via a VELCRO closure; a cord adjustment permits the user to adjust the length of the tether.

Clark, et al. (U.S. Pat. No. 5,244,206) disclose a hip-mounted polo-like game device, including a belt, a tethered ball, and a playing ball. The length of the belt can be adjusted via a VELCRO closure or a conventional buckle closure; the length of the tether can be adjusted by a loop or a VELCRO tab.

May (U.S. Pat. No. 5,199,715) shows a game device having two frames, each frame belted to a player's waist. Each frame has a horizontal target surface laid out in VELCRO. The frames are connected by an elastic cord, from which hangs a ball covered in mating VELCRO fabric.

Other types of devices have a plurality of sites for securing balls, game pieces, and other objects. Stewart (U.S. Pat. No. 4,971,334) discloses a throw and catch game where each player wears a vest having several VELCRO patches and scoring data. The object of the game is to throw a soft projectile (a cube with a mating VELCRO patches on each side) at another player.

Fidalgo's body contact game is played with an adjustable belt having a plurality of hooks which are attached to mounts on the belt (U.S. Pat. No. 4,765,748). The belt has a VELCRO closure and several VELCRO patches to which various game pieces can be attached.

The Roberts (U.S. Pat. No. 4,596,387) athletic shoes have flexible handles which assist the user in securing a hold on his feet or toes to perform various exercises. The shoes have several pairs of snaps for securing the handles; the length of each handle can be adjusted via a VELCRO closure.

Fryer (U.S. Pat. No. 3,479,027) shows several harnesses, a tie, and a cape, all bearing several VELCRO patches to which a series of game pieces (with VELCRO backings) can be attached. All of the above-described devices use hook-and-loop type materials such as VELCRO in a conventional manner, either to provide an adjustable closure or to attach one item to another.

Devices with adjustable tethers are also known in the art. For example, Killion, et al. (U.S. Pat. No. 5,358,258) describe a soccer training device that includes a waist-mounted belt and a flexible, elastic tether for the ball. They suggest adjusting the length of the tether by a buckle arrangement.

DiSabatino, et al. (U.S. Pat. No. 4,121,822) disclose an exercise and game apparatus with a belt and shoulder strap. The strap has several loops to which the user can attach the tether of a resilient ball; the length of the tether can be adjusted.

In U.S. Pat. No. 4,911,432 (entitled "Hip Mounted Exercising Device"), the disclosure of which is incorporated herein by reference, I describe an aerobic exercising device that mounts across the hips of the user. The device includes a rebound board, a belt, a ball, and an elastic tether. The belt goes around the user's hips and holds the rebound board against the user's front; one end of the elastic tether is attached to the ball, and the other end is attached to the rebound board. The ball is rebounded back and forth from the rebound board by the reciprocal back-and-forth movement of the user's hips. This exercise places emphasis on the hips, thighs, stomach, and buttocks while elevating the heart rate to aerobic levels.

Frequent tether adjustments are required to enjoy the full range of use of the Hip Mounted Exercising Device. These adjustments relate to the length of the tether and to its vertical position of attachment along the face of the rebound board. The tether adjustments must coordinate with the weight and size ball being used, with the height, weight, and body configuration of the user, and also with each individual user's peculiarity of motion. A high degree of accuracy is essential in making these adjustments: even slight variations in the length and vertical position of the tether can adversely affect the rhythm required to propel the ball to its maximum distance and keep it in constant play (it is when the ball is thus in full play that the maximum aerobic benefits of the Hip Mounted Exercising Device are derived). To the user, it soon becomes evident that adjusting the tether as described in U.S. Pat. No. 4,911,432, is cumbersome and time consuming; and, even through tedious trial and error, accuracy (i.e., optimum length and placement) is virtually impossible to achieve. Making the necessary tether adjustments limits the user's overall enjoyment, and also limits the range of use and effectiveness of the Hip Mounted Exercising Device.

There is a need for an adjustable tether that is easy to customize, and that eliminates the time-consuming, inherently imprecise limitations of the Hip Mounted Exercising Device. A tether that can be quickly and accurately adjusted to meet an individual user's needs is crucial to obtaining the full benefits of the device. Such a tether would also be useful for other devices where its length and position may need to be adjusted.

SUMMARY OF THE INVENTION

According to its major aspects and broadly stated, the present invention includes a method and a user-adjustable device for achieving high levels of aerobic exercise in an enjoyable fashion. The device includes a rebound board, a first strip of hook-and-loop fastening material attached to the rebound board, and a precision tether adjuster including a tether having a first end attached to a ball and a second end attached to a second, mating strip of hook-and-loop fastening material. The tether is threaded through a hole in the second strip. Thus threaded, with the weight of the ball pulling the tether taut, the second strip is held in front of the rebound board and the tether is moved up or down through the hole to determine the particular user's desired length. The excess length of the tether is then wrapped around the second strip, which is mated horizontally across the first strip at the appropriate vertical level for the user. The length and vertical position of the tether are now optimized to suit the user's requirements, and the tether is secured firmly between the mating strips of hook-and-loop fabric.

An important feature of the present invention is the precision tether adjuster, which facilitates adjustments in both the tether's length and vertical position with respect to the rebound board. The quick and accurate adjustability of the tether, both in length and in vertical position with respect to the rebound board, is a feature of paramount importance: it promotes surprising ease in adjusting the device to an individual user's skill, exercise style, and desired intensity of exercise (mild, strenuous, etc.). It also permits the user to change the length and position of the tether as his or her needs change, whether to accommodate a different exercise intensity, increasing skill in the use of the device, or a ball having a different size or weight. Furthermore, the invention allows a single user to have several balls available for use with a single rebound board, whether balls of different sizes or weights, or balls with tethers of different lengths for different exercise routines. Alternatively, several users can share a single board, with each user having his or her own, customized, ball-and-tether combination.

Since the length of the tether and its vertical position along the face of the rebound board are independently adjustable—one does not alter the other—precise coordination between the two adjustments is easily accomplished. Indeed, the horizontal position of the tether may also be adjusted if desired. The ease, speed, and precision that the present invention provides in making these essential tether adjustments enhances all aspects of using the Hip Mounted Exercising Device.

Another feature of the present invention is the material used for the first and second strips of the precision tether adjuster. Either of the strips may be made of hook-type or loop-type fastening material, with the other strip made of a mating material. In a preferred embodiment of the invention, the second strip is made of a material having sufficient stiffness that the strip does not readily bend when wound with the tether; thus, the second strip remains substantially flat and easily attachable to the first strip even when snugly wound with the tether. Laminated materials having a hook surface on one side and a loop surface on the reverse side are broadly suitable for use with the invention; hook-type or loop-type materials attached to backing layers may also be useful. Second strips wherein the softer, loop side faces outwards when the second strip is mated to the first strip are generally preferred as providing a more comfortable "feel" and at least somewhat more traction while pressing the strip in place on the rebound board.

Still another feature of the present invention is the rebound board, which can be made of wood, plastic, metal, or other suitable material. In a preferred embodiment of the invention, the board rests against the user's pelvic area, and provides a rebound surface for the ball. Appropriate movement of the user's hips and torso causes the ball to bounce off the board, extend outwards therefrom, and be returned thereto by the tether. Alternatively, the rebound board may be some other game or exercise device from which a ball is rebounded back and forth: a bat, paddle, or other hand-held device, a board attached to a wall or other suitable support, and so forth. Both skill and uniform rhythm are required to maintain the repetitive bounding of the ball on the rebound board, thus, continued use builds skill and provides significant aerobic exercise.

Yet another feature of the present invention is its flexibility, since the device can be used to achieve gentle, rhythmic exercise (with gentle body movements), or more vigorous exercise (with more strenuous movement and, optionally, weights held in the hands or strapped to the wrists).

Other features and advantages of the present invention will be apparent to those skilled in the art from a careful reading of the Detailed Description of Preferred Embodiments presented below and accompanied by the drawings.

DETAILED DESCRIPTION OF PREFERRED EMBODIMENTS

Figure 1:
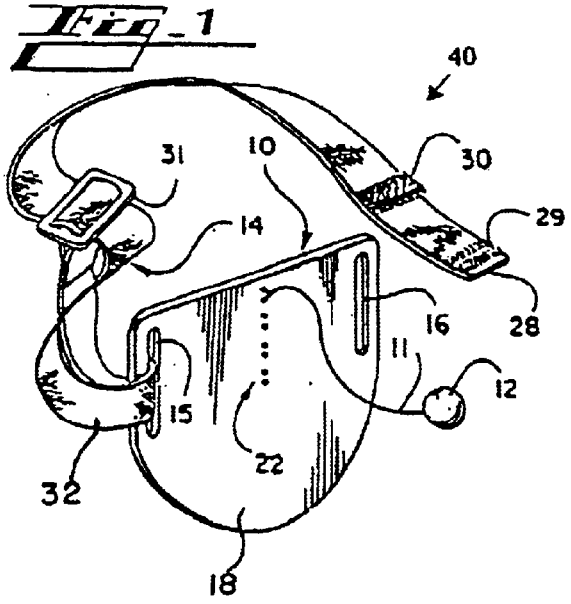
FIG. 1 is a perspective view of the device of U.S. Pat. No. 4,911,432.

In the following detailed description of the invention, reference numerals are used to identify structural elements, portions of elements, surfaces or areas in the drawings, as such elements, portions, surfaces or areas may be further described or explained by the entire written specification. For consistency, whenever the same numeral is used in different drawings, it indicates the same element, portion, surface or area as when first used. Unless otherwise indicated, the drawings are intended to be read together with the specification, and are to be considered a portion of the entire written description of this invention as required by 35 U.S.C. § 112. As used herein, the terms "horizontal," "vertical," "left," "right," "up," "down," as well as adjectival and adverbial derivatives thereof, refer to the relative orientation of the illustrated structure as the particular drawing figure faces the reader.

Before proceeding to a description of the present invention, a review of the Hip Mounted Exercising Device of U.S. Pat. No. 4,911,432 is in order. As shown in FIGS. 1–5, a hip mounted exercising device 40 includes four major components: a rebound board 10 having an elastic tether 11 fixed thereto; a belt or strap 14 which is attachable to the rebound board through elongated belt slots 15 and 16; a ball 12 attached to the distal end of tether 11. Rebound board 10 is mounted across the hips of the user by means of belt 14.

Figure 2:
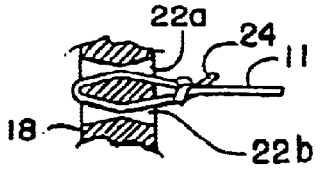
FIGS. 2 and 3 are enlarged fragmentary cross-sectional views of the device of FIG. 1.
Figure 3:
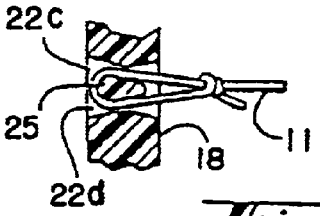

Rebound board 10 is provided with a plurality of openings or holes 22 therethrough so that tether 11 can be tied through one or more of the openings, as shown in FIGS. 2 and 3. Once tether 11 is threaded through selected holes (designated at 22*a* and 22*b*, FIG. 2), the tether is knotted as at 24 or otherwise secured to itself. For a rebound board 10 made of molded plastic, holes 22 may be molded in the rebound board at the time the board itself is molded, forming openings such as 22*c* and 22*d* with a central portion 25 to hold tether 11 (FIG. 3).

In order to hold rebound board 10 in position on a person's hips, strap 14 is removable and adjustable. Strap 14 includes a free end 28 carrying strips of hook-and-loop material designated at 29 and 30, respectively. Thus, end 28 can be passed through slot 16, and hook material 29 can be placed against loop material 30 for providing a loop. The opposite end of belt 14 carries a buckle 31, which can be moved along strap 14 to increase or decrease the size of a loop 32 which passes through slot 15.

Figure 4:
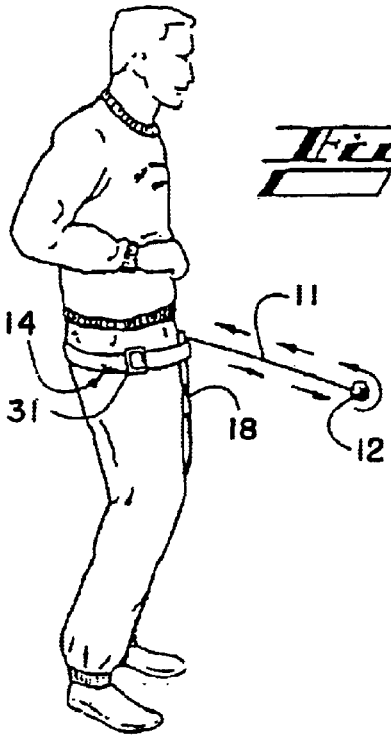
FIGS. 4 and 5 show the device of FIG. 1 mounted on a person and illustrating mild and more strenuous forms of exercise, respectively.
Figure 5:
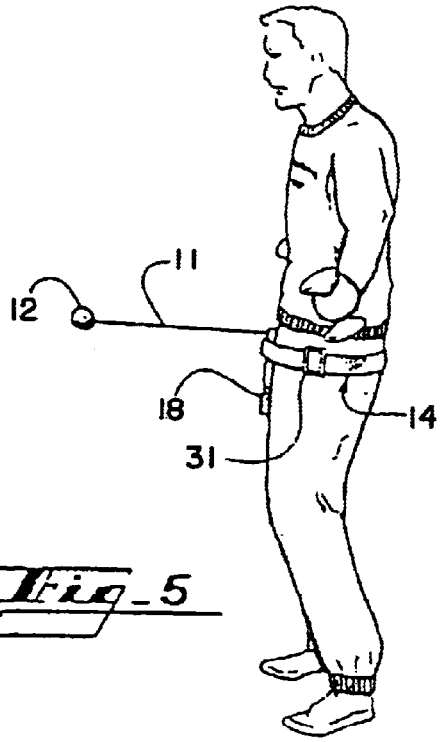

When rebound board 10 is in a suitable position across the user's hips and in front of the pelvic area, and when the length of tether 11 and its vertical position along a face 18 of the rebound board are optimally adjusted to suit the individual user, ball 12 is pulled forward and released to initiate the first bounce from the rebound board. Once the first bounce is initiated, ball 12 is kept in rebounding play by the reciprocal back-and-forth motion of the user's hips. This rhythmic exercise has been judged to meet aerobic standards when sustained for a sufficient period of time; and, respective to the speed of motion, it can be used mildly or vigorously as illustrated in FIGS. 4 and 5. A mild form of exercise is shown in FIG. 4; a more vigorous mode can be adopted by faster and/or more extensive movement, or by holding weights in each hand while keeping the ball in play as illustrated in FIG. 5. The more forceful the movement of the person's hips, the more strenuous the exercise: by thrusting the hips forwardly more forcefully to cause ball 12 to move farther out, tether 11 stretches to a greater extent, necessitating a counter-balancing force provided by moving the upper torso through a greater distance. When weights are held in each hand (as in FIG. 5), the arm motion required to maintain coordination intensifies the exercise to the upper regions of the body. A mild form of exercise can be used by beginners; more strenuous forms can be used as the person becomes better conditioned.

For optimum effect in attaining aerobic levels of activity with device 40, the length of tether 11 and the vertical position of its attachment to the face of rebound board 10 must be precisely adjusted to accommodate the individual user's body and idiosyncrasy of motion. In conjunction with these adjustments, the tether length and vertical position must also be adjusted to coordinate with the different sizes and weights of the balls that may be used with device 40. These two tether adjustments—length and vertical position—are crucial to the proper use of device 40, and to the overall range of activity attainable by the user. Even slight variations in these tether adjustments respective to each individual user can negatively affect the rhythm required to keep the ball in vigorous play and to sustain aerobic-level exercise.

The above-described method of making tether adjustments using vertically-aligned holes 22 involves time-consuming trial and error. Precision—and, therefore, optimum tether length and position—is virtually impossible to achieve. The user must thread tether 11 from the front to the back of rebound board 10 through one of a pair of vertically aligned holes 22, then back to the front through the second hole, thus forming a loop in the tether which is secured by tying a knot. More commonly, tether 11 is simply threaded through a selected one of vertically aligned holes 22, and a knot large enough to keep the tether from pulling through the hole is tied. Either method is tedious, and, with the imprecision of tying and untying a large knot, even a rough approximation of the requisite length of tether 11 is often lost. The knots tied are frequently tied too small to hold tether 11 securely to rebound board 10; in addition, the pulling action of ball 12 sometimes distends a knot causing it to be pulled forward out of the hole 22*a* or 22*b* and the tether to become unfastened. Also, the wear and tear of tying knots in tether 11 results in weakness and premature breakage. Fixing the proximal end of tether 11 on a vertical level along the front of rebound board 10 lacks precision as well: the vertical positions are limited to the respective levels of the several vertically-aligned holes 22 along face 18. When using device 40, it is essentially impossible to make tether adjustments while the user is wearing the device; removing the device for each trial-and-error adjustment impedes development of the rhythm necessary for aerobic-level exercise. It is also not practical for several individuals to share device 40—for example, while exercising at a health club—since passing the device from one user to another commonly requires tether adjustments respective for each user. Because of the frequent tether adjustments required, exchanging balls 12 of different sizes and weights is not practical either.

To further exacerbate the user's difficulties in adjusting device 40, holes 22 cannot practicably be drilled closely enough together to accommodate the needed precision in vertical positioning. Also, vertical adjustments in the position of tether 11 with respect to rebound board 10 cannot be made independently of length adjustments to the tether itself: with each vertical adjustment, the end of the tether has to be untied; hence, with each vertical adjustment, the length of the tether also has to be readjusted. This lack of independence respective to vertical adjustments renders the necessary coordination between the length of tether 11 and its vertical position along the face of rebound board 10 virtually impossible to achieve. These difficulties in customizing the fit of device 40 restrict its use and enjoyment.

Figure 6A:
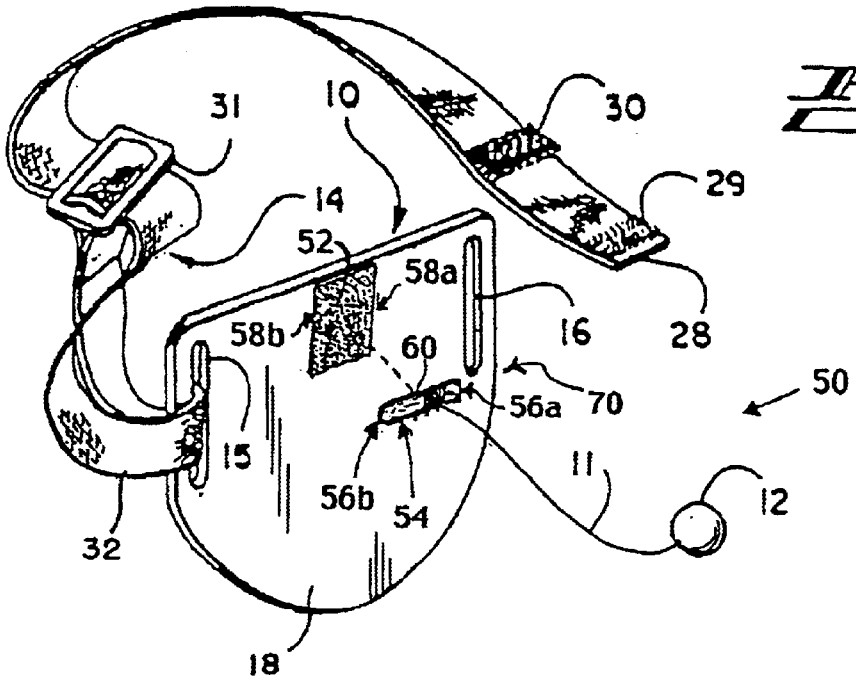
FIGS. 6A and 6B are perspective views of a hip mounted exercising device with a precision tether adjuster according to a preferred embodiment of the present invention, shown with the tether unfastened and fastened, respectively.
Figure 6B:
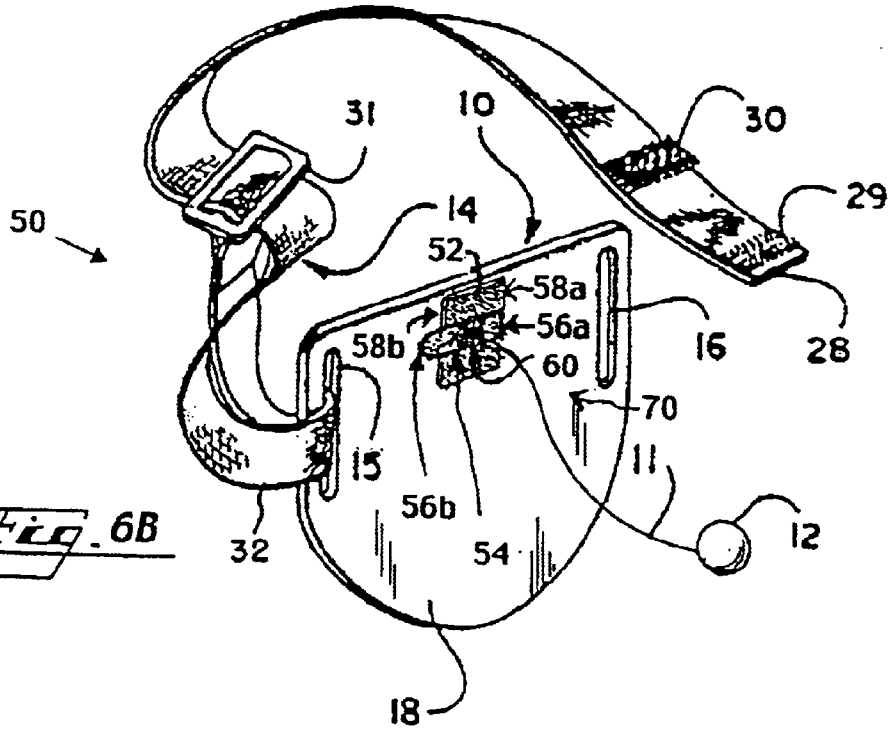

Referring now to FIGS. 6A and 6B, there is shown a hip mounted exercising device with a precision tether adjuster according to a preferred embodiment of the present invention. Device 50 includes a rebound board 10, a tether 11, a ball 12 secured to a distal end of tether 11, a belt or strap 14 with strips 29 and 30 of hook-and-loop material and a buckle or other closure 31, and a pair of vertically elongate slots 15 and 16 for receiving strap 14. Tether 11 is made of a suitable elastic material, stretchable material, or elastic stretchable material.

As will be described further below, device 50 utilizes hook-and-loop type fastening material (including but not limited to materials marketed under the trademark VELCRO) for adjusting the length and placement of tether 11. A rectangular piece of fastening material, preferably several inches long and having a sufficiently large surface area to accommodate the desired vertical range of positions of tether 11, is permanently attached to the upper center of rebound board 10. Tether 11 is threaded through a hole that has been punched through a narrow strip of mating material. Thus threaded, and with the weight of ball 12 pulling the tether taut, the strip is held in front of the rebound board and the tether is moved up or down through the hole. When the desired length between the fastening strip and ball 12 is determined, the excess length of tether 11 is wrapped the appropriate number of times around the strip. Thus wrapped, the material from which the strip is constructed remains generally flat and easily attachable, even when snugly wound with a portion of the length of tether 11. The strip is then mated horizontally across the opposing rectangular piece of fastening material at the precise level along its several inch span that is best suited to the particular user. The length and vertical position of tether 11 are now optimized to suit the requirements of a particular user; the tether is secured firmly between the two pieces of hook-and-loop fastening material; and the proximal end of the tether is attached securely to the face of rebound board 10.

The complementary relationship between the present invention and the complex range of exercise activity that it promotes can be appreciated as it develops in the following description. A precision tether adjuster 70 includes two strips of hook-and-loop fastening material as described above: a first strip 52 attached in some secure manner—glued, bonded, stapled, etc.—to face 18 of rebound board 10 (FIGS. 6A and 6B), and a second, mating strip 54. First strip 52 is situated approximately at the top lateral center of rebound board 10, extending lengthwise downward and perpendicular to the lateral plane of the board. Second strip 54 is mated generally horizontally across first piece 52. One end 56*a* of strip 54 is preferably straight-sided (i.e., squared or squared off), and the other end 56*b* is preferably at least somewhat rounded. When square end 56*a* is mated approximately evenly with either of straight sides 58*a*, 58*b* of first strip 52, rounded end 56*b* extends somewhat, preferably by approximately one inch (2.5 cm or thereabouts), beyond first strip 52, thereby forming a tab that facilitates the attachment and removal of second strip 54.

A hole 60, of a size that readily accommodates threading therethrough of elastic tether 11, is punched through second strip 54 at a point from square end 56*a* equal to approximately half the width of first strip 52. Hence, when square end 56*a* of second strip 54 is mated evenly (or approximately so) with either of straight sides 58*a*, 58*b* of first strip 52, hole 60 and the threaded tether 11 are approximately in the lateral center of first strip 52, and, correspondingly, approximately in the lateral center of rebound board 10.

For example, first strip 52 may be approximately 3" long and 1–2" wide (about 7.6 by 2.5–5.1 cm), and preferably has an outwardly-facing side of "loop"-type material. Second strip 54 may be approximately 0.5–1" wide and 3" long (about 1.3–2.5 by 7.6 cm), and has an inwardly-facing side of the mating "hook"-type material. However, the dimensions of strips 52 and 54 may vary depending on the dimensions of rebound board 10 and the desired range of adjustments. If desired, strips 52 and 54 may be of hook-type and loop-type material, respectively.

With the above arrangement in mind, the operation of the present invention can now be followed. The user threads tether 11 though hole 60 in second strip 54. Then, while holding strip 54 of precision tether adjuster 70 generally horizontally in front of rebound board 10 at approximately the desired vertical level, and with the weight of ball 12 pulling tether 11 taut, the user moves tether 11 up or down through hole 60, thereby decreasing or increasing the distance of ball 12 relative to second strip 54. When tether 11 is adjusted to a length that gives ball 12 the desired distance of play, the tether is held in that position as the excess of its proximal end (typically approximately 4–6 inches or about 10–15 cm), is wrapped one or more times around second strip 54, thereby letting the user set tether 11 at the length that gives ball 12 its optimum distance of play. Thus wrapped, second strip 54 can now be flatly and securely mated horizontally at any selected level on the vertical length of the opposing first strip 52, thus letting the user position the proximal end of tether 11 at the optimum vertical level. Furthermore, when the two opposing pieces of fastening material (i.e., first strip 52 and second strip 54) are firmly mated, the wrappings of tether 11 are held securely between them, thereby fixing the tether at the desired length. The proximal end of tether 11 is secured against face 18 of rebound board 10 at the desired vertical level.

Although adjustments to tether 11 tend to become less frequent as the user develops skill and coordination in using device 50, some trial-and-error experimentation may be necessary to enjoy the full range of use encompassed by the device: for example, as a person develops coordination, a longer tether 11 may be useful in achieving a greater rebound distance of ball 12; transition to this more advanced level naturally requires additional adjustments to the tether. Unlike the method of making tether adjustments described in U.S. Pat. No. 4,911,432—which involved threading the tether 11 through a hole and/or holes 22 in rebound board 10 and laboriously tying and untying large knots—the present invention makes it possible for adjustments to be done with ease and in a matter of seconds. Furthermore, due to the use of mating hook and loop surfaces on first and second strips 52 and 54, the adjustments are always surprisingly precise and easy to accomplish. Beyond facilitating all aspects of the basic use of device 50 and making possible the quick and easy development of skill and coordination, the present invention broadens the use of all devices having rebound boards with attached tethers in ways that were either not possible or practical prior to its implementation.

Figure 7A:
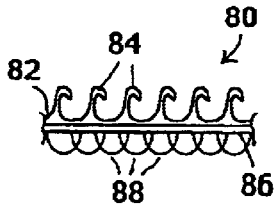
FIGS. 7A–C are cross-sectional views of materials usable for a precision tether adjuster according to the present invention.
Figure 7B:
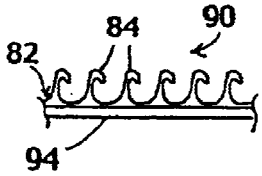
Figure 7C:
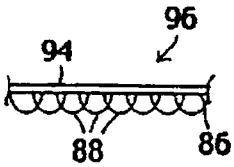

Second strip 54 may be made of a laminated material such as the materials shown schematically in FIGS. 7A–C. A laminated material 80 (FIG. 7A) has a base layer 82 with a plurality of projections 84 that form the hook side of the material. The loop side of material 80 consists of a layer 86 with loops 88 attached to base layer 82. A second strip 54 made of material 80 has a loop surface on one side (layer 82 with projections 84) and a hook surface on the opposing side (layer 86 with loops 88). Laminated materials such as material 80 tend to be somewhat thicker than hook-type or loop-type materials. Thus, a second strip 54 made of material 80 does not readily bend when wound with tether 11, and remains flat and easily attachable to first strip 52 even when the tether is snugly wound. If first strip 52 is a loop-type material, the hook side of second strip 54 is used; conversely, if first strip 52 is a hook-type material, the loop side of second strip 54 is used. Suitable materials are sold under the trademarks GET-A-GRIP and GRIP STRIPS; however, other materials of this type are also suitable.

Another laminated material 90 (FIG. 7B) has a base layer 82 attached to a backing layer 94, and still another laminated material 96 (FIG. 7C) has a layer 86 attached to a backing layer 94. Second strips 54 made of materials 90 and 96 are used with first strips 52 of loop-type and hook-type materials, respectively. These and other types of laminated materials are broadly suitable for use with the invention, and may be manufactured by any techniques known in the art.

While first strip 52 may have an outwardly-facing side of hook-type material, a loop-type material is preferred when second strip 54 is made of laminated material 80. In this embodiment of the invention, the softer, loop side of second strip 54 is outwards, providing a more comfortable tactile surface for the user. A loop-type fabric (or the loop side of material 80) is also believed to give at least somewhat more "finger traction" while pressing the strip in place on rebound board 10.

If desired, a single rebound board 10 may be used with a plurality of balls 12, each ball attached to its own tether 11 and second strip 54. Balls 12 may, for example, be of different sizes and/or weights, and may be used by the same person to achieve different levels of aerobic exercise with device 50. Alternatively, balls 12 may be the same or different balls, wherein each combination of a ball 12, tether 11, and second strip 54 is customized for a different user, in a situation where several users share a single rebound board 10 (this situation might arise in an exercise class or a health club where members share equipment). Above described strips 52, 54 make possible a quick exchange of different balls 12 with only a slight interruption of the ongoing use of device 50.

Rebound board 10 may be made of wood, metal, plastic (including molded plastic), composite materials, or indeed any other suitable materials. With respect to first and second strips 52, 54, it is understood by those skilled in the art that any shape can be cut from bulk stock of hook-and-loop fastening material (often supplied under the trademark VELCRO); and that computer-controlled machines can rapidly produce volumes of specially shaped units. It will also be understood that incorporating first and second strips 52 and 54 into the manufacture of device 50 is more efficient than the schema used with device 40.

Strap or belt 14 is shown as having a buckle 31 for length adjustment. It should be understood, however, that strap 14 could have a conventional tongue-and buckle closure, a snap buckle, a snap closure, or some other type of adjustable closure if preferred. Tether 11 may be made of any suitable material that is at least somewhat elastic and stretchable; and ball 12 is any suitable type of ball that can be used with rebound board 10.

The present invention overcomes all of the problems and limitations inherent in making the various adjustments to tether 11 that are essential to the viable use of the Hip Mounted Exercising Device; and it makes possible the full range of activity for which the Hip Mounted Exercising Device was intended; and it also greatly facilitates the manufacture of the Hip Mounted Exercising Device. First and second strips 52, 54, in combination with adjustable strap 14, optimize the fitting of device 50 to an individual user while allowing that user maximum comfort and freedom of motion.

Figure 8A:
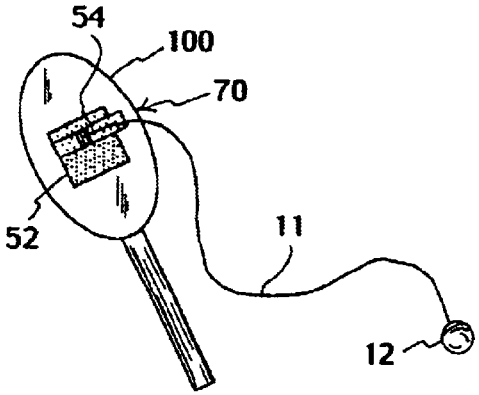
FIGS. 8A and 8B are perspective views of additional exercising devices with precision tether adjusters according to the present invention.
Figure 8B:
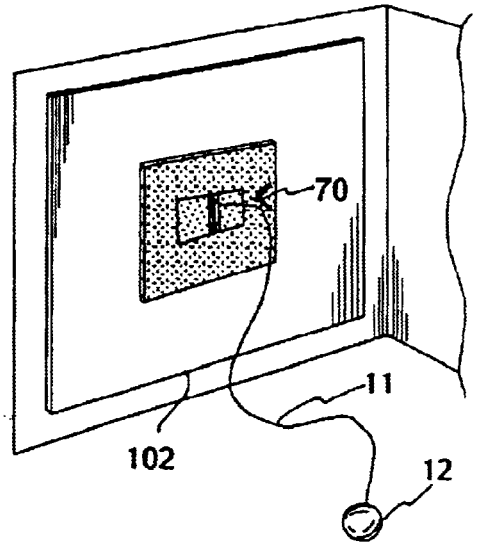

It will be evident that precision tether adjuster 70, including first strip 52 and second strip 54 (to which tether 11 is attached), can be used with other types of exercise devices. By way of example, first strip 52 can be attached to a paddle or racket 100 (FIG. 8A) or a wall-mounted rebound board 102 (FIG. 8B). The length of tether 11 can be adjusted as described above to provide the desired degree of free play to ball 12.

With respect to the above description of the invention, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing description is considered as illustrative only of the principles of the invention. Further, since numerous modifications and changes will readily occur to those skilled in the art, it is not desired to limit the invention to the exact construction and operation shown and described, and, accordingly, all suitable modifications and equivalents that fall within the scope of the invention may be resorted to. Thus, it will be apparent to those skilled in the art that many changes and substitutions can be made to the preferred embodiment herein described without departing from the spirit and scope of the present invention as defined by the appended claims.

What is claimed is:

1. An exercising device for providing aerobic exercise for a person, said device comprising:

a rebound board receivable in front of the pelvic area of a person, said rebound board including a pair of vertically elongate slots and a forwardly facing rebound surface;

strap means for holding said rebound board against said pelvic area, said strap means received by said pair of slots, said strap means having sufficient length for passing around the hips of said person;

a ball adapted for elastically colliding with and rebounding from said rebound surface; and an adjustable tether, said adjustable tether including a tether having a first end and a second end, said first end being attached to said ball, and user-adjustable means for securing said tether to said rebound board, said securing means having a first strip attached to said rebound board and a second strip attached to said second end of said tether, said second strip having a hole therethrough, said hole dimensioned for accommodating said tether, said first and second strips being matable with each other to secure said tether to said rebound board.

2. The device as recited in claim 1, wherein said first strip has an outwardly-facing surface of hook or loop material.

3. The device as recited in claim 1, wherein said second strip is made of hook or loop material.

4. The device as recited in claim 1, wherein said second strip is made of a laminated material having a first side with an outwardly-facing hook surface and a second side with an outwardly-facing loop surface.

5. The device as recited in claim 1, wherein said second strip is made of a laminated material having a side with a hook surface or a loop surface.

6. The device as recited in claim 1, wherein said first strip is approximately 2" wide and approximately 3" long, and wherein said second strip is approximately ½" wide and approximately 3" long.

7. The device as recited in claim 1, wherein said second strip has a first, squared end and a second, at least somewhat rounded end.

8. The device as recited in claim 1, wherein said hole is positioned approximately at the center of said second strip, at approximately one-half the width of said first strip from said first end.

9. The device as recited in claim 1, wherein said tether is made of an elastic material, a stretchable material, or an elastic stretchable material.

10. The device as recited in claim 1, wherein said first strip is attached at a lateral center of said rebound board, and wherein said first strip extends downwards from a top edge of said rebound board.

11. The device as recited in claim 1, wherein said rebound surface is substantially flat.

12. The device as recited in claim 1, wherein said strap means has a width less than the length of said elongate slots so that said rebound board can be vertically adjusted with respect to said strap means.

13. The device as recited in claim 1, further comprising adjusting means for varying the effective length of said strap means.

14. A method for exercising aerobically, said method to be carried out by a person, said method including the steps of:

placing a rebound board in front of the pelvic area of a person, said rebound board including a pair of vertically elongate slots and a forwardly facing rebound surface, strap means for holding said rebound board against said pelvic area, said strap means received by said pair of slots, said strap means being sufficient in length to pass around the hips of said person, a ball adapted for elastically colliding with and rebounding from said rebound surface, a tether having a first end and a second end, said first end being attached to said ball, said tether made of an elastic material, a stretchable material, or an elastic stretchable material, and user-adjustable means for securing said tether to said rebound board, said securing means having a first strip attached to said rebound board and a second strip attached to said second end of said tether, said first and second strips being matable with each other to secure said tether to said rebound board, said securing means operable for adjusting a length and a position of said tether with respect to said rebound board;

using said securing means, adjusting said length and said position of said tether with respect to said rebound board; and placing said second strip on a selected position on said first strip to secure said tether to said rebound board.

15. The method as recited in claim 14, wherein said length-adjusting step further comprises wrapping said tether about said second strip a selected number of times.

16. The method as recited in claim 14, further comprising the steps of:

removing said second strip from said first strip; and placing said second strip on a different selected position on said first strip.

17. The method as recited in claim 14, further comprising mating said second strip horizontally across said first strip at a selected vertical position along the vertical span of said first strip, wherein at least a portion of said tether is held between said first and second strips, thereby securing said tether to said rebound board.

18. The method as recited in claim 14, wherein said second strip has a squared end, further comprising mating said squared end approximately evenly with a vertical side of said first strip to position said hole approximately at a lateral center of said first strip.

19. The method as recited in claim 14, further comprising the steps of:

bending the knees and simultaneously moving the hips forwardly as said ball strikes said rebound board, thereby projecting said ball forwardly, then straightening the knees and simultaneously moving the hips rearwardly, thereby causing said tether to pull said ball towards said rebound board and imparting a propelling bounce to said ball, and repeating said bending and straightening steps rhythmically to cause rebounding of said ball off said rebound board synchronously with the back-and-forth motion of the user's hips.

20. A precision tether adjuster for use with a rebound board, comprising:

a tether having a first end and a second end, said first end being attachable to an item;

a first strip attachable to a rebound board, said first strip having an outwardly-facing surface;

a second strip attached to said second end of said tether, said second strip having at least one surface matable with said outwardly-facing surface of said first strip, said first and second strips being matable with each other to secure said tether to said rebound board.

21. The precision tether adjuster as recited in claim 20, wherein said outwardly-facing surface of said first strip is a hook or loop material.

22. The precision tether adjuster as recited in claim 20, wherein said second strip includes a hook or loop material.

23. The precision tether adjuster as recited in claim 20, wherein said second strip is made of a laminated material having a first side with an outwardly-facing hook surface and a second side with an outwardly-facing loop surface.

24. The precision tether adjuster as recited in claim 20, wherein said second strip has a first, squared end and a second, at least somewhat rounded end, and wherein said second strip has a hole therethrough, said hole dimensioned for accommodating said tether.

25. The precision tether adjuster as recited in claim 20, wherein said hole is positioned approximately at the center of said second strip, at approximately one-half the width of said first strip from said first end.

26. The precision tether adjuster as recited in claim 20, wherein said tether is made of an elastic material, a stretchable material, or an elastic stretchable material.

27. An exercising device for providing aerobic exercise for a person, said device comprising:

a rebound board receivable in front of the pelvic area of a person, said rebound board including a pair of vertically elongate slots and a forwardly facing rebound surface;

strap means for holding said rebound board against said pelvic area, said strap means received by said pair of slots, said strap means having sufficient length for passing around the hips of said person;

a ball adapted for elastically colliding with and rebounding from said rebound surface; and an adjustable tether, said adjustable tether including a tether having a first end and a second end, said first end being attached to said ball, and user-adjustable means for securing said tether to said rebound board, said securing means having a first strip attached at a lateral center of said rebound board, said first strip extending downwards from a top edge of said rebound board, said first strip having an outwardly-facing surface of hook or loop material, and a second strip attached to said second end of said tether, said second strip made of hook or loop material, said first and second strips being matable with each other to secure said tether to said rebound board.

28. The device as recited in claim 27, wherein said second strip is made of a laminated material having a first side with an outwardly-facing hook surface and a second side with an outwardly-facing loop surface.

29. The device as recited in claim 27, wherein said second strip is made of a laminated material having a side with a hook surface or a loop surface.

30. The device as recited in claim 27, wherein said second strip has a first, squared end and a second, at least somewhat rounded end.

31. The device as recited in claim 27, wherein said second strip has a hole therethrough, said hole dimensioned for accommodating said tether.

32. The device as recited in claim 27, wherein said second strip has a hole therethrough, said hole being positioned approximately at the center of said second strip, at approximately one-half the width of said first strip from said first end.

33. The device as recited in claim 27, wherein said tether is made of an elastic material, a stretchable material, or an elastic stretchable material.

34. The device as recited in claim 27, wherein said rebound surface is substantially flat.

35. The device as recited in claim 27, wherein said strap means has a width less than the length of said elongate slots so that said rebound board can be vertically adjusted with respect to said strap means.

36. The device as recited in claim 27, further comprising adjusting means for varying the effective length of said strap means.

* * * * *